US006381909B1

(12) United States Patent
Liao

(10) Patent No.: US 6,381,909 B1
(45) Date of Patent: May 7, 2002

(54) CORNER TRANSOM FITTING FOR FRAMELESS TEMPERED GLASS DOOR

(76) Inventor: Shou-Hsing Liao, 5F, No. 159, Sec. 1, Hua-Mei W. Street, Taichung City (TW)

( * ) Notice: Subject to any disclaimer, the term of this patent is extended or adjusted under 35 U.S.C. 154(b) by 0 days.

(21) Appl. No.: 09/660,933

(22) Filed: Sep. 13, 2000

(51) Int. Cl.[7] ..... E06B 3/36

(52) U.S. Cl. ..... 52/204.58; 52/204.57; 52/204.65; 49/388; 49/399

(58) Field of Search ..... 52/204.53, 204.54, 52/204.58, 204.62, 204.65, 656.2, 656.4, 656.9, 235, 213; 49/388, 399, 501

(56) References Cited

U.S. PATENT DOCUMENTS 3,604,154 A * 9/1971 Curran ..... 49/388
3,685,240 A * 8/1972 Oscari ..... 52/235
3,828,394 A * 8/1974 Horgan, Jr. ..... 16/129
4,513,474 A * 4/1985 Watabe ..... 16/243
4,523,414 A * 6/1985 Horgan, Jr. ..... 52/204

* cited by examiner

*Primary Examiner*—Carl D. Friedman
*Assistant Examiner*—Yvonne M. Horton
(74) *Attorney, Agent, or Firm*—Bacon & Thomas, PLLC

(57) ABSTRACT

A corner transom fitting of a frameless tempered glass door. A first seat has an L shape, and through holes and screw holes are installed and locked by the locking studs. The first seat has a long side installed with a protruding resisting block for placing and resisting against the glass so as to prevent the glass from falling down. The first seat is installed at one side of the glass. A second seat has a shape with respect to a long side of the first seat and is installed at another side of the glass with respect to the glass. A third seat is at a position with respect to a short side of the first seat. The first seat, the second seat, and the third seat serve to be formed as a corner transom fitting of a frameless tempered glass door.

2 Claims, 10 Drawing Sheets

CORNER TRANSOM FITTING FOR FRAMELESS TEMPERED GLASS DOOR

BACKGROUND OF THE INVENTION

The present invention relates to a device of a frameless tempered glass door, and especially to a corner transom fitting of a frameless tempered glass door.

Since the enhancing safety glass has a good light transparency and safety effect, it is widely used in many stores with a thigh safety requirement. Therefore, the consumers may view the commodities within the store; moreover, the space of the store will be felt more widely (referring to FIG. 1).

FIG. 1 shows a general glass structure, which is formed by several pieces of glasses, which has possibly five pieces, at left, right, upper sides and two doors, or a three pieces, at lateral side, top side and a single door (not shown). However, in assembly, several peoples hold the pieces of glasses and the upper corners are enclosed. Thus, it is time-consuming and cost wasting in assembly.

Referring to FIG. 2, a prior art upper enclosing device is made to two opposed seats which are match with packing pieces, washers and locking studs for clamping glass therein. The seat has an inverse L shape and is formed integrally. As the glass is assembled, several peoples hold the upper and lower sides of the glass and hold the two seats for locking. Therefore, many labors are required in assembly.

SUMMARY OF THE INVENTION

Accordingly, the primary object of the present invention is to provide an corner transom fitting of a frameless tempered glass door, therein the enclosing device is formed by three pieces so that the cost in working is saved.

Another object of the present invention is to provide an corner transom fitting of a frameless tempered glass door, wherein The upper left corners of the third seat is installed with a notch. A prolonging block protrudes from the second seat so that in assembly, the second seat and third seat are parallel. An embedding groove is installed in the resisting block of the first seat; a regulating piece is embedded into the embedding groove; the regulating piece is adjusted with a thickness of the clamped glass so that the corner transom fitting clamps the glass steadily.

In order to achieve the aforesaid objects, the present invention provides a corner transom fitting of a frameless tempered glass door. A first seat has an L shape, and a plurality of through holes and screw holes are installed for being penetrated and locked by the locking studs. The first seat has a long side installed with a protruding resisting block for placing and resisting against the glass so as to prevent the glass from falling down; and the first seat is installed at one side of the glass. A second seat has a shape with respect to a long side of the first seat and is installed at another side of the glass with respect to the glass. A third seat is at a position with respect to a short side of the first seat, is at another side of the glass with respect to the first seat and is the side of the first seat so as to be respective to the first seat. By aforesaid structure, the first seat, second seat, and third seat serve to be formed as a corner transom fitting of a frameless tempered glass door. The upper left corners of the third seat is installed with a notch. A prolonging block protrudes from the second seat so that in assembly, the second seat and third seat are parallel. An embedding groove is installed in the resisting block of the first seat; a regulating piece is embedded into the embedding groove; the regulating piece is adjusted with a thickness of the clamped glass so that the corner transom fitting clamps the glass steadily.

The various objects and advantages of the present invention will be more readily understood from the following detailed description when reading in conjunction with the appended drawing.

DETAILED DESCRIPTION OF THE PREFERRED EMBODIMENTS

Figure 1:
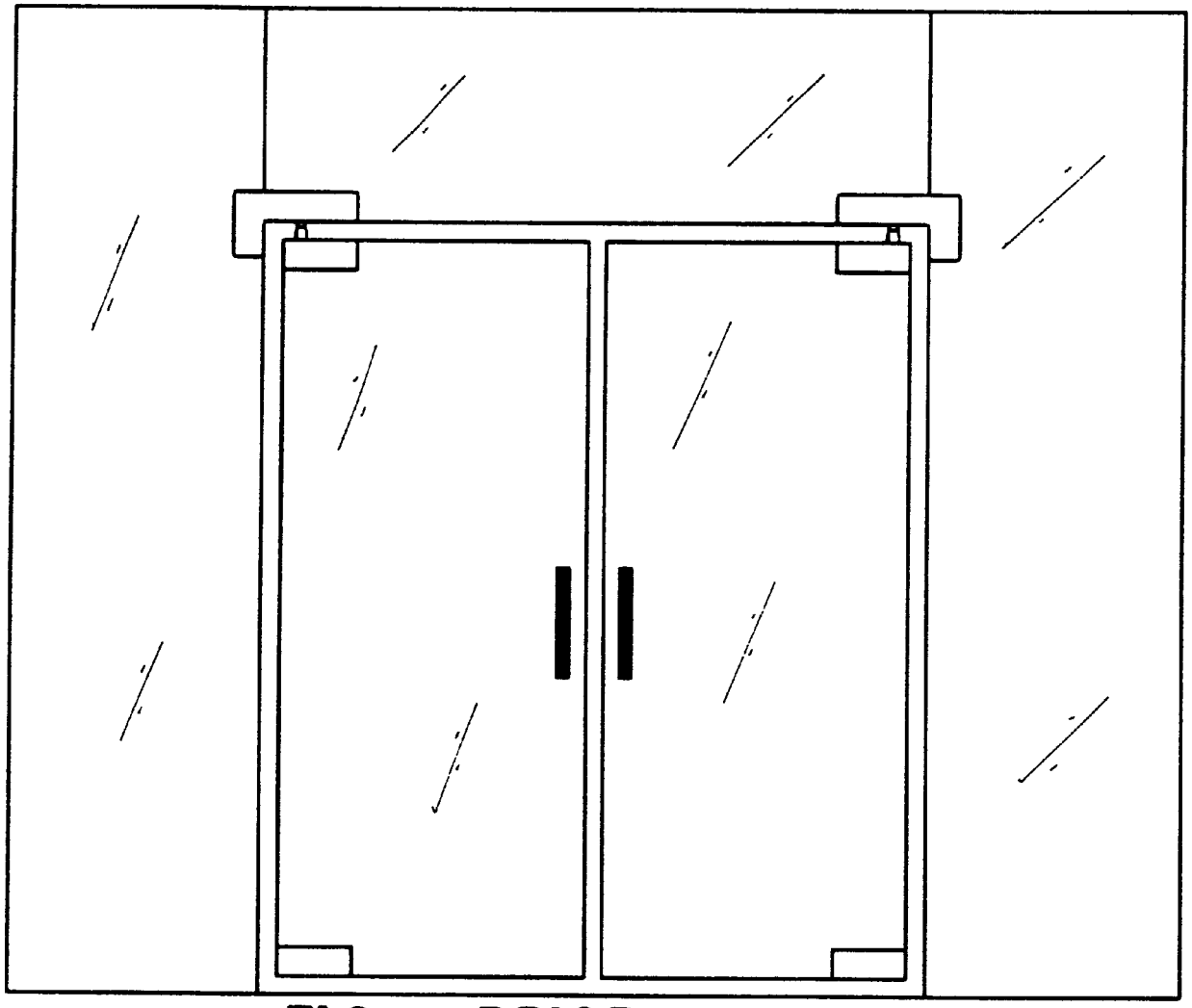
FIG. 1 PRIOR ART
FIG. 1 shows the structure of a prior art enhancing safety glass formed by five pieces.
Figure 2:
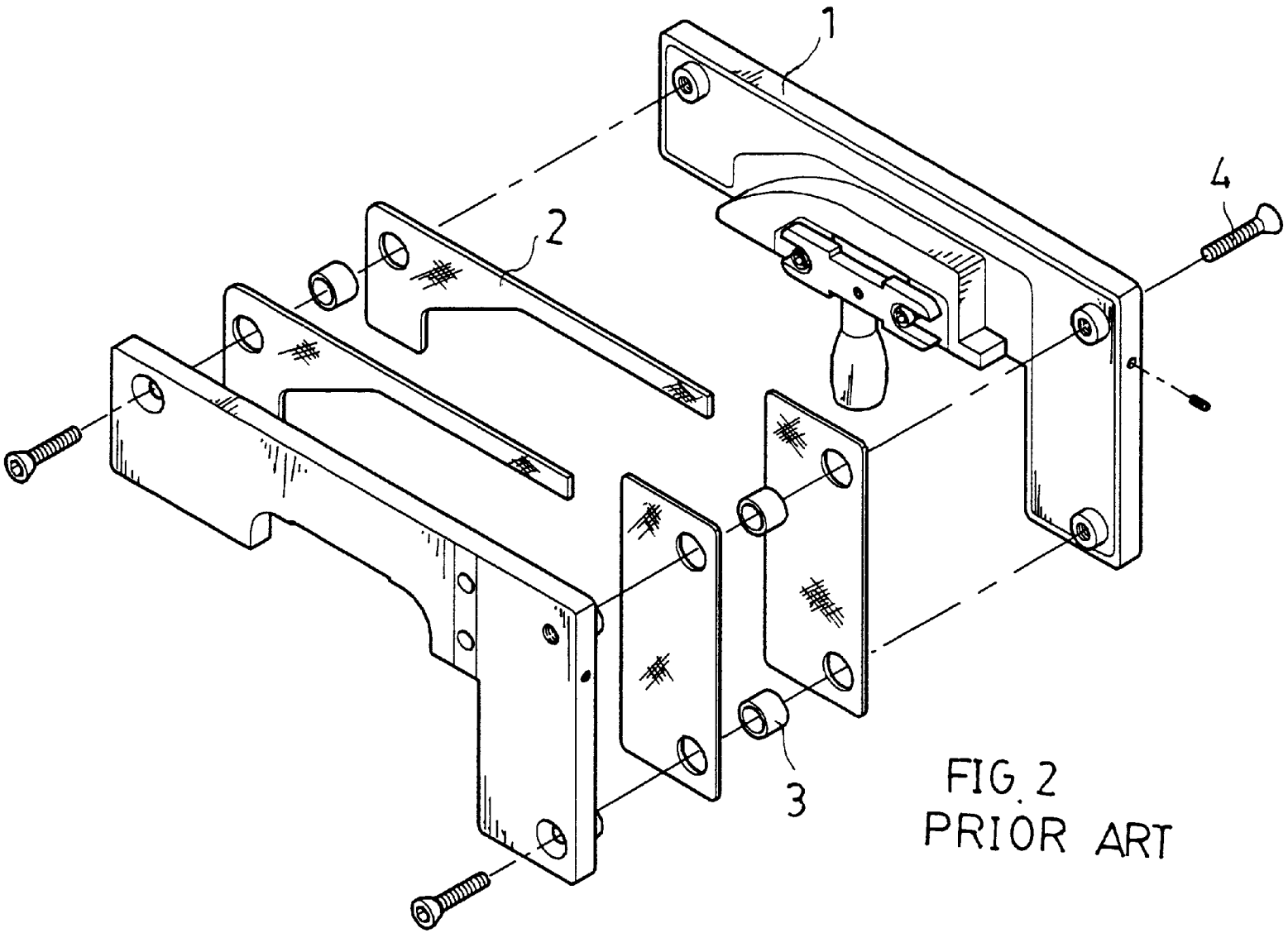
FIG. 2 PRIOR ART
FIG. 2 is a perspective view showing the prior art enclosing device of the upper corner of a door.
Figure 3:
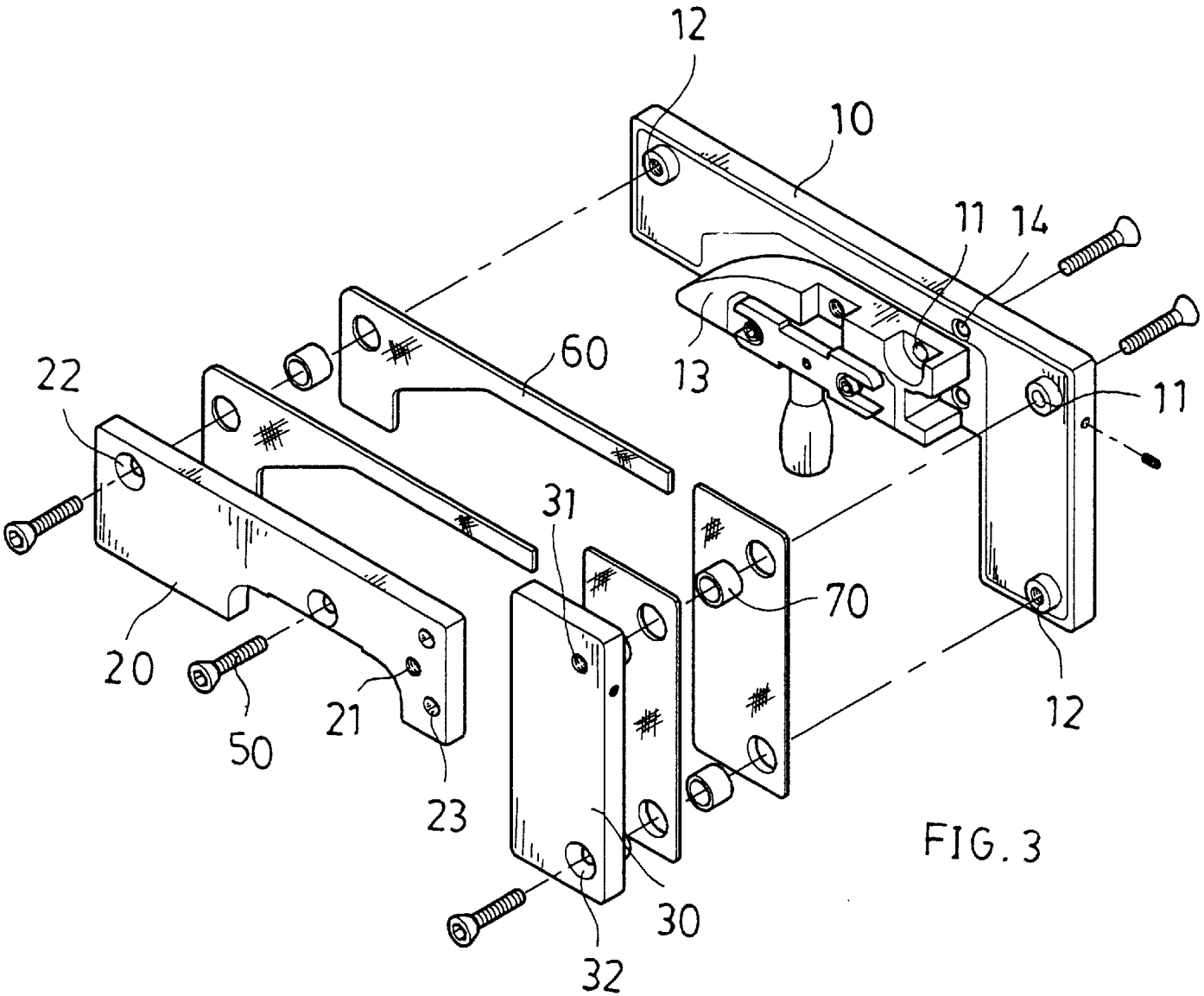
FIG. 3 is an exploded perspective view of the present invention.
Figure 4:
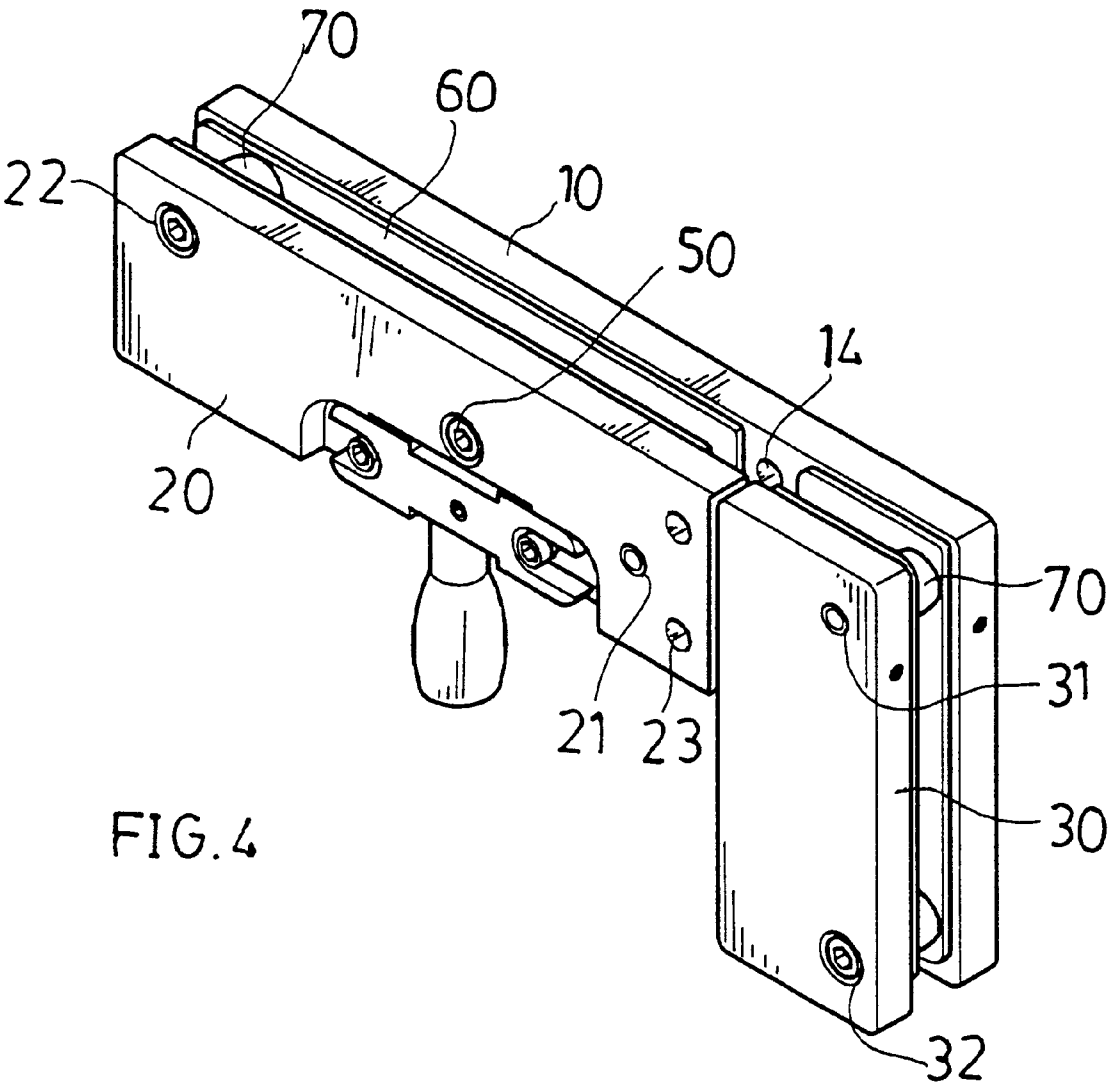
FIG. 4 is an assembled perspective view of the present invention.
Figure 5:
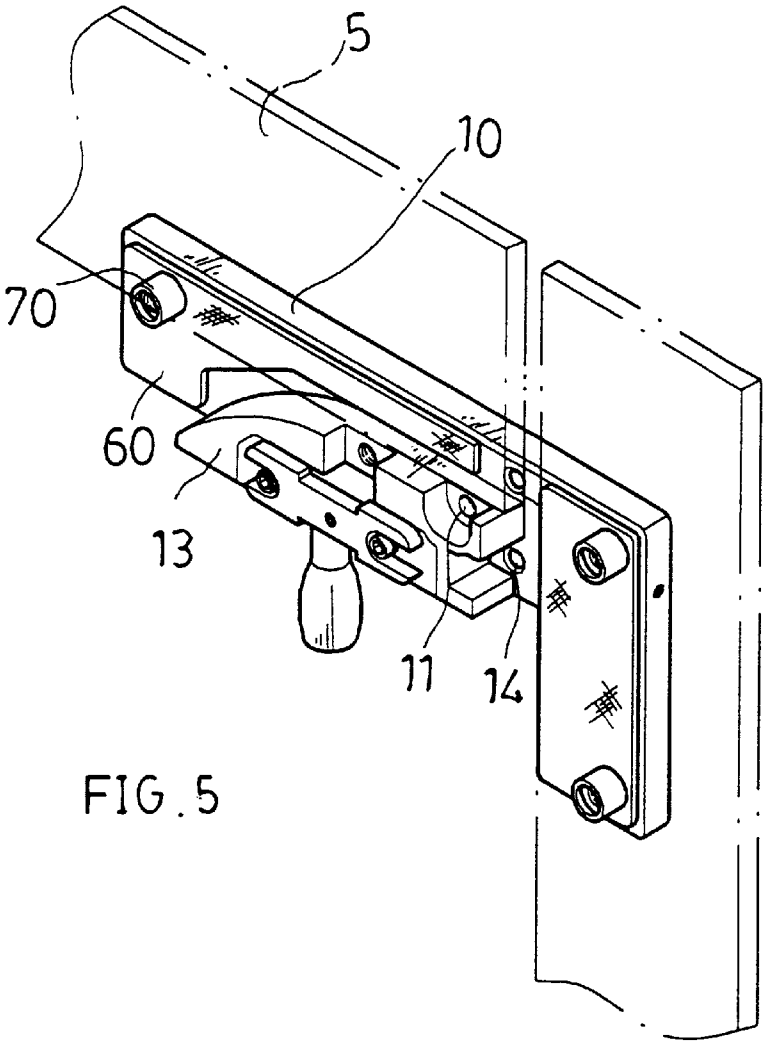
FIG. 5 is a schematic view showing the action of the present invention.
Figure 6:
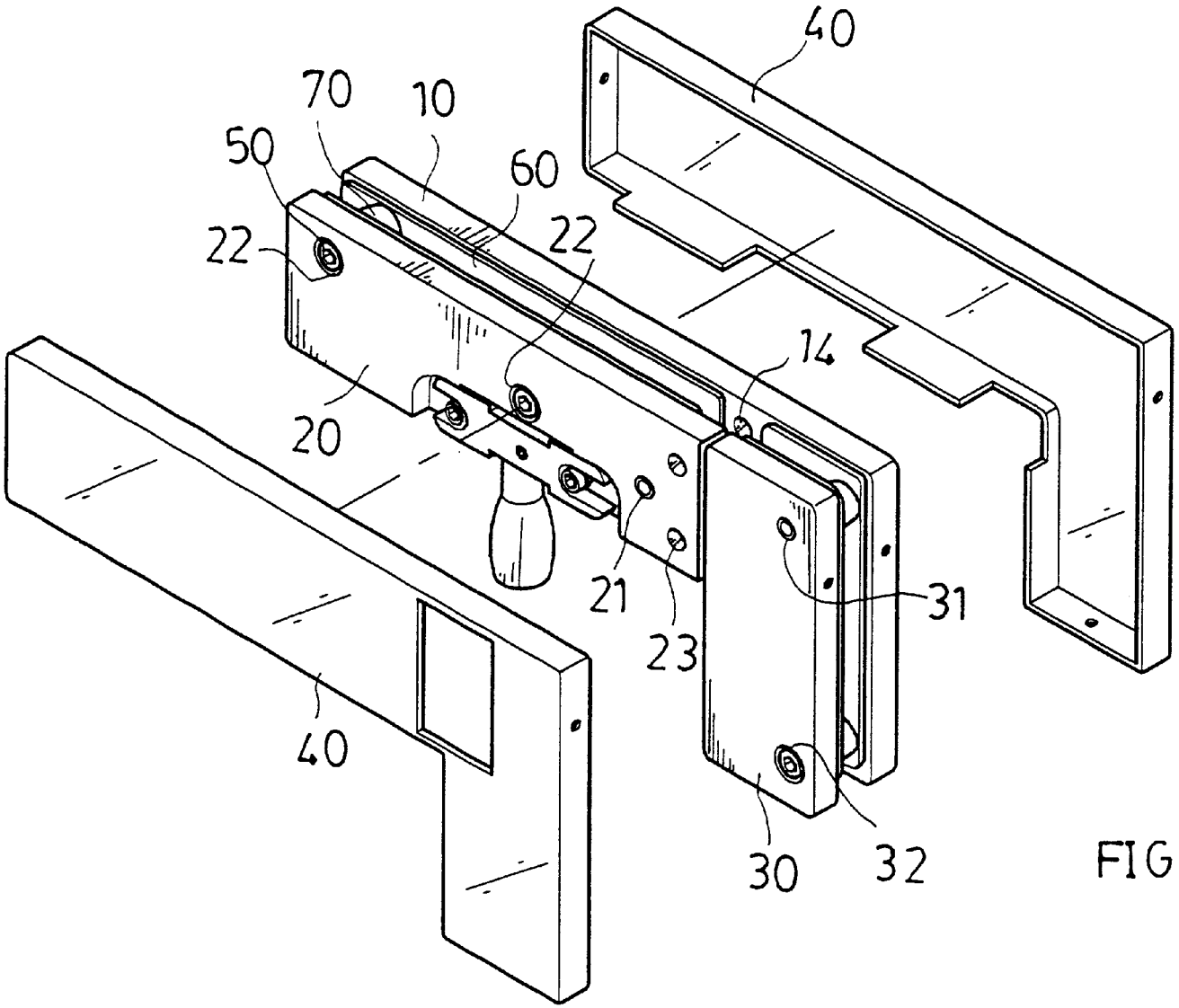
FIG. 6 is a schematic view showing the cover piece of the present invention.
Figure 7:
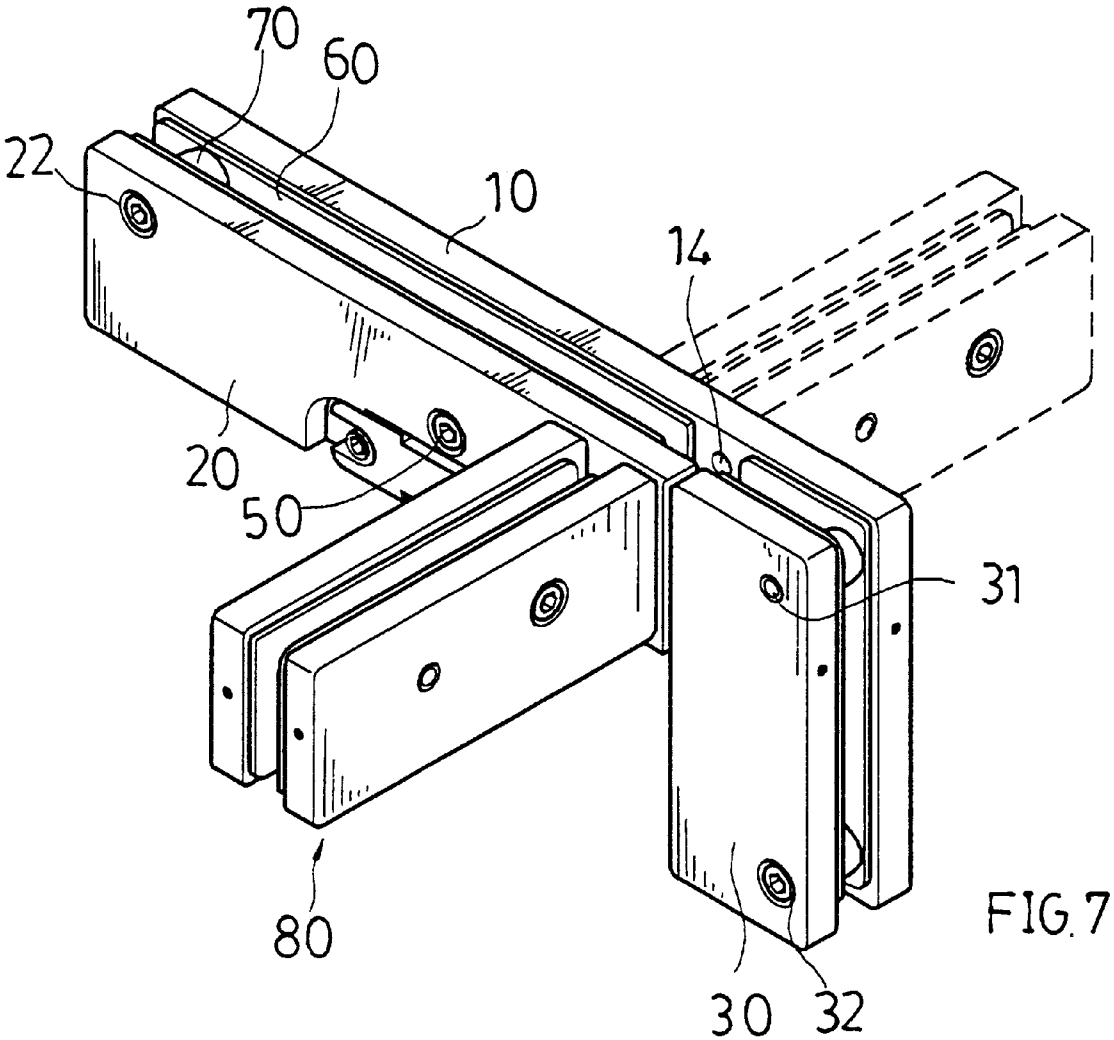
FIG. 7 is a schematic view showing the rear-resisting block of the present invention.

Referring to FIGS. 3 to 7, the preferred embodiments of the present invention are illustrated with the appended figures.

The present invention primarily includes a first seat 10, a second seat 20, a third seat 30, a plurality of cover pieces 40, a plurality of locking studs 50, a plurality of packing pieces 60 and a plurality of washers 70. The corner transom fitting of the present invention is assembled from the aforesaid components and enclosing upper sides of the glass 5 for protecting and securing.

The first seat 10 has an L shape, and a plurality of through holes 11 and screw holes 12 are installed for being penetrated and locked by the locking studs 50. The first seat 10 has a long side installed with a protruding resisting block 13 for placing and resisting against the glass 5 (see FIG. 5) so as to prevent the glass 5 from falling down. The first seat 10 is installed at one side of the glass 5.

The second seat 20 has a shape with respect to the long side of the first seat 10 and is installed at another side of the glass 5 with respect to the glass 5. The second seat 20 is installed with a plurality of through holes and screw holes with respective to the plurality of through holes and screw holes of the first seat 10.

The third seat 30 is at a position with respect to the short side of the first seat 10, is at another side of the glass 5 with respect to the first seat 10 and is at the side of the first seat 10 so as to be at a position respective to the first seat 10. The third seat 30 is installed with a plurality of screw holes 31 and a plurality of through holes with respect to the through holes 11 and the screw holes 12 of the first seat 10.

The plurality of packing pieces 60 and washers 70 are installed between the first seat 10, the second seat 20, and third seat 30. Thereby, as enclosing the glass 5, it may protect the glass 5 from being collided and destroyed. The collision in the corners will induce that the cracking the whole glass.

The present invention is assembled from aforesaid components. In assembling the present invention, one holds the glass 5, and another clamps the glass 5 between the first seat 10 and the third seat 30 so that long lateral side of the first seat 10 is protruded out, i.e. the operator originally holding the lateral surface converts to hold the upper side of the glass 5. Then, the second seat 20 is locked to the first seat 10 so that the first seat 10 and second seat 20 clamps the glass 5 therein. Therefore, after assembled, covering pieces cover all the seats for presenting a beautiful outlook.

Another, at the long lateral side of the first seat 10 near the short lateral side is formed with two holes 14. The second seat 20 is installed with two holes 23 with respect to the holes 14 of the first seat 10. The holes serve to be added with a rear stop to the first seat 10 or the second seat 20 (see FIG. 7). Therefore, another glass 5 can be added internally or externally for supporting the original overlarge or over high structure.

Figure 8:
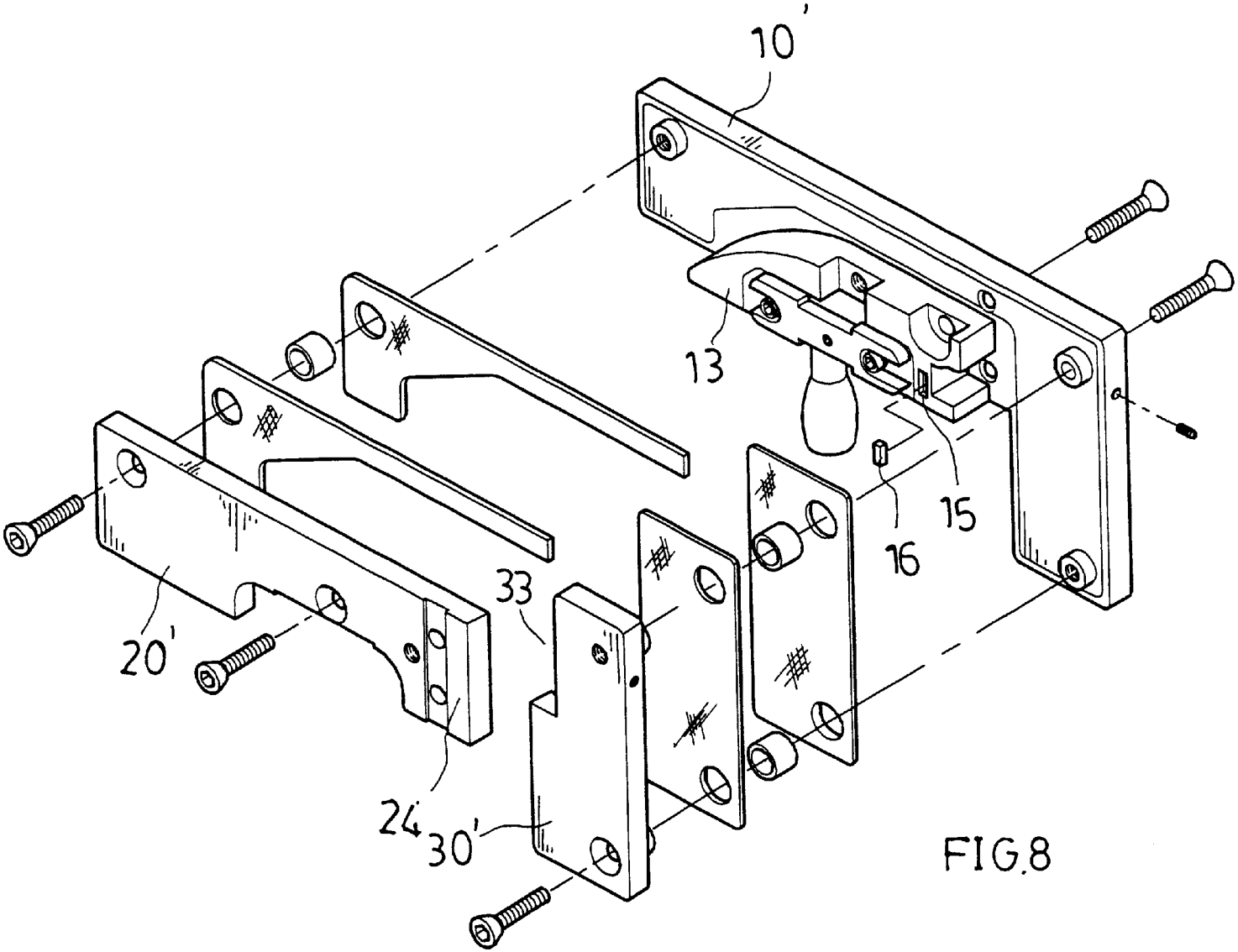
FIG. 8 is an exploded perspective view of another embodiment in the present invention.
Figure 9:
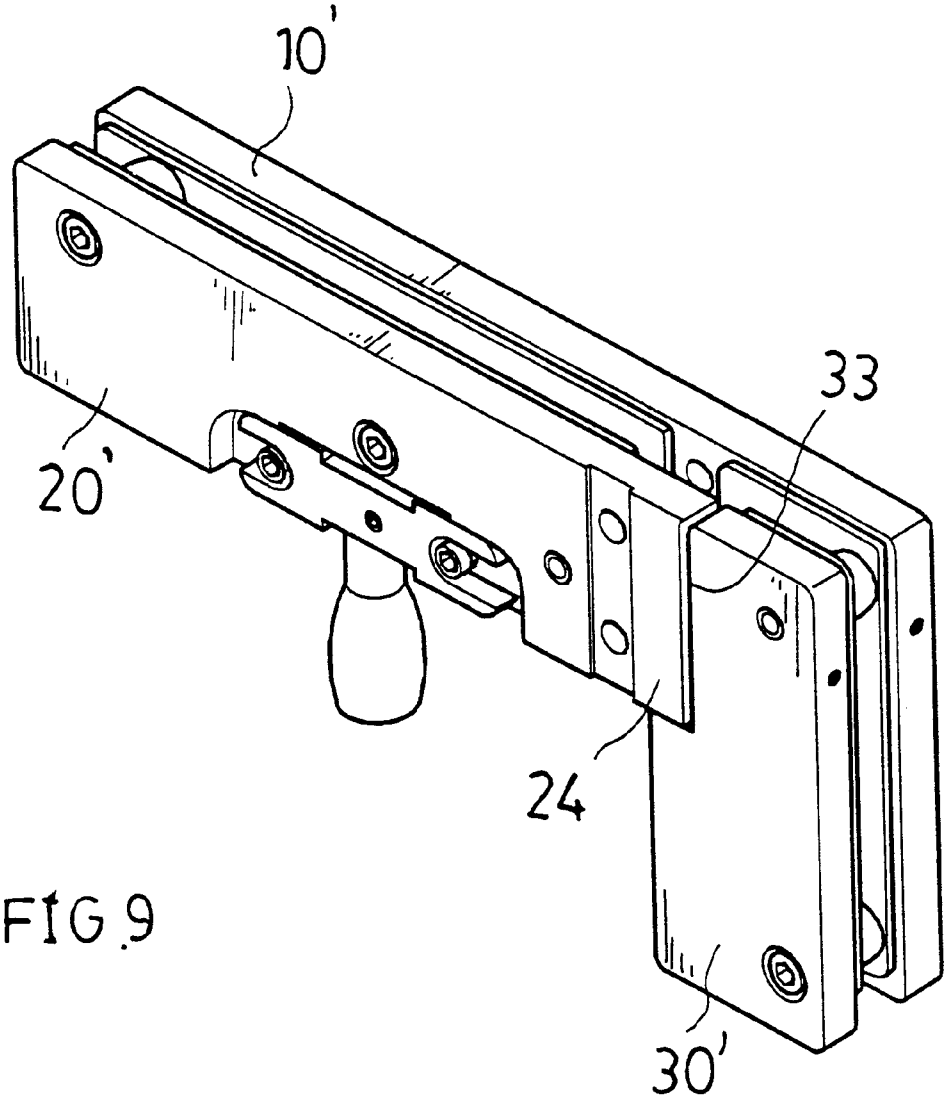
FIG. 9 is an exploded perspective view of another embodiment in the present invention.
Figure 10:
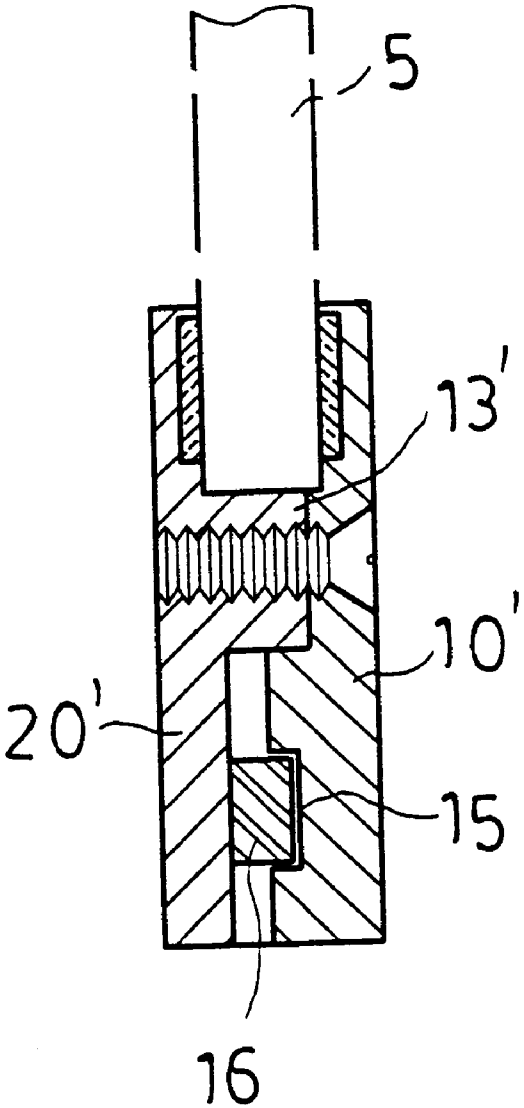
FIG. 10 is a schematic view of another embodiment in the present invention in which a glass is clamped.

Moreover, in order that the present invention can be used in glass of different thickness (referring FIGS. 8 to 10). The upper left corners of the third seat 30' is installed with a notch 33. A prolonging block 24 protrudes from the second seat 20' so that in assembly, the second seat 20' and third seat 30' are parallel. An embedding groove 15 is installed in the resisting block 13' of the first seat 10'. A regulating piece 16 is embedded into the embedding groove 15. As in the present invention, when the thickness of the clamped glass 5 is larger than that of the resisting block 13', the first seat 10' and second seat 20' are locked so as to be formed with a tilt angle so that the glass 5 can not be clamped. Therefore, other than the design of the notch 33 and the prolonged block 24 to cause that the second seat 20' and third seat 30' are parallel, further, through the adjustment of the regulating piece 16, the tilt angle from the locking of the first seat 10' and second seat 20' can be removed so that the first seat 10' and second seat 20' clamps the glass 5 steadily.

In summary, in the present invention, by the structure of the first seat, second seat, and third seat. A frameless tempered glass door can be assembled easily. A further rear stop can be further added for supporting the original overlarge or over high structure. In the present invention, the locking studs are locked alternatively from two lateral sides, and as the studs in one side is released, the studs in another side still has the function of locking so that the glass can be clamped more steadily.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A corner transom fitting of a frameless tempered glass door, wherein each upper corner of a frameless tempered glass door is enclosed by a first seat, a second seat, a third seat, a plurality of cover pieces, a plurality of locking studs, a plurality of packing pieces and a plurality of washers, these components encloses two sides of the glass for protecting and securing:

the first seat has an L shape, and a plurality of through holes and screw holes are installed in the first seat for being penetrated and locked by the locking studs; the first seat has a long side installed with a protruding resisting block for placing and resisting against the glass so as to prevent the glass from falling down; and the first seat is installed at one side of the glass;

the second seat has a shape with respect to a long side of the first seat and is installed at another side of the glass with respect to the glass; the second seat is installed with a plurality of through holes and screw holes with respective to the plurality of through holes and screw holes of the first seat;

the third seat is at a position with respect to a short side of the first seat, is at another side of the glass with respect to the first seat and is the side of the first seat so as to be respective to the first seat; the third seat is installed with a plurality of screw holes and a plurality of through holes with respect to the through holes and the screw holes of the first seat;

wherein by the aforesaid structure, the first seat, second seat, and third seat serve to be formed as an corner transom fitting of a frameless tempered glass door; and wherein at a long lateral side of the first seat near a short lateral side is formed with two holes; the second seat is installed with two holes with respect to the holes of the first seat; these holes serve to be added with a rear stop to the first seat or the second seat; the upper left corners of the third seat is installed with a notch; a prolonging block protrudes from the second seat so that in assembly, the second seat and third seat are parallel.

2. The corner transom fitting of a frameless tempered glass door as claimed in claim 1, wherein an embedding groove is installed in the resisting block of the first seat; a regulating piece is embedded into the embedding groove; the regulating piece is adjusted with a thickness of the clamped glass so that the corner transom fitting clamps the glass steadily.

* * * * *